US005152807A

United States Patent [19]

Sexton et al.

[11] Patent Number: 5,152,807

[45] Date of Patent: Oct. 6, 1992

[54] FUEL OIL COMPOSITIONS CONTAINING GUANIDINIUM SALTS

[75] Inventors: Michael D. Sexton, Oxfordshire; Rosalind H. Strange, Bath, both of England

[73] Assignee: Exxon Chemical Patents Inc., Linden, N.J.

[21] Appl. No.: 493,877

[22] Filed: Mar. 15, 1990

[30] Foreign Application Priority Data

Mar. 16, 1989 [GB] United Kingdom ..... 8906027

[51] Int. Cl.[5] ..... C10L 1/14

[52] U.S. Cl. ..... 44/409; 44/420; 44/421; 562/34; 564/241

[58] Field of Search ..... 44/420, 421, 409, 450; 562/34, 480, 493, 606, 607, 590; 564/238, 240, 241

[56] References Cited

U.S. PATENT DOCUMENTS

| | | | |
|---|---|---|---|
| 1,939,659 | 12/1933 | Calcott et al. | 44/9 |
| 2,134,959 | 11/1938 | Sibley | 44/9 |
| 2,710,303 | 6/1955 | Whitney | 562/34 |
| 2,917,378 | 12/1959 | Vitalis et al. | 52/0.5 |
| 3,062,630 | 11/1962 | Di Piazza | 44/409 |
| 3,387,954 | 6/1968 | Capowski et al. | 44/422 |
| 3,597,174 | 8/1971 | Alquist et al. | 44/74 |
| 3,923,668 | 12/1975 | Johnston | 252/16 |
| 3,965,084 | 6/1976 | Schiff | 562/34 |
| 4,011,057 | 3/1977 | Sayers | 44/52 |
| 4,149,980 | 4/1979 | Abdul-Malek | 562/34 |
| 4,261,703 | 4/1981 | Tack et al. | 44/339 |
| 5,032,144 | 7/1991 | Jessup | 44/420 |

FOREIGN PATENT DOCUMENTS

| | | |
|---|---|---|
| 283294 | 9/1988 | European Pat. Off. . |
| 293192 | 11/1988 | European Pat. Off. . |
| 2005816 | 8/1971 | Fed. Rep. of Germany . |
| 1457520 | 11/1966 | France . |
| 1121681 | 7/1968 | United Kingdom . |
| 1272499 | 4/1972 | United Kingdom . |

OTHER PUBLICATIONS

Offenhauer et al., Industrial and Engineering Chemistry, 1957, vol. 49, p. 1265.

*Primary Examiner*—Prince Willis, Jr.
*Assistant Examiner*—Thomas Steinberg
*Attorney, Agent, or Firm*—V. T. White

[57] ABSTRACT

Sediment and color formation in diesel and heating fuel oils, especially those comprising a cracked fraction, may be reduced by incorporating in the fuel oil a guanidinium or substituted guanidinium salt.

10 Claims, No Drawings

FUEL OIL COMPOSITIONS CONTAINING GUANIDINIUM SALTS

This invention relates to fuel oil compositions and more especially to fuel oil compositions containing cracked components which are stabilized against sediment formation and colour development during storage. Cracked components are frequently included to give higher yields of diesel fuel and heating oil.

However, when diesel and heating oils containing cracked components are stored at ambient or elevated temperatures in air they become discoloured and precipitate sludge or sediment.

It is clear that the problem of discoloration and sediment formation is exacerbated by the presence of cracked components in the fuel. This is demonstrated by the results in Table 1 which show the amount of sediment formed and the colour change when various fuel blends are tested in the AMS 77.061 accelerated stability test. Published research (see, for example, Offenhauer et. al, Industrial and Engineering Chemistry, 1957, Volume 49, page 1265, and the Proceedings of the 2nd International Conference on the Long Term Stability of Liquid Fuels, San Antonio, Tex., published October 1986) suggests that discoloration and sediment result from the oxidation of sulphur and nitrogen compounds present in the fuel. The analysis of cracked components is consistent with this. The results in Table 2 show that cracked components contain significantly larger quantities of nitrogen and sulphur than straight distillates. Also, the addition of nitrogen and sulphur compounds to a stable straight distillate causes an increase in both sediment and colour in the AMS 77.0621 test (Table 3) with the worst result being obtained when both nitrogen and sulphur compounds are present in the fuel.

It has been found that sediment and colour formation in diesel fuels and heating fuels may be substantially reduced by incorporating a small amount of a guanidinium or substituted guanidinium compound in the fuel. The guanidinium or substituted guanidinium additive is particularly effective when the diesel fuel or heating fuel contains cracked components.

The present invention provides a fuel oil composition comprising a mineral diesel fuel oil or heating fuel oil, and an additive which is a guanidinium salt or substituted guanidinium salt.

The guanidinium compounds are preferably of the general formula:

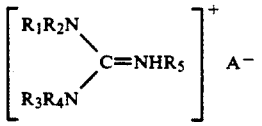

$R_1$, $R_2$, $R_3$, $R_4$ and $R_5$, which may be the same or different, are each hydrogen, or a substituted or unsubstituted alkyl, cycloalkyl, alkenyl, cycloalkenyl, or aryl group, and $A^-$ is an organic anion. Each of the groups $R_1$ to $R_5$ may have from 1 to 40 carbon atoms. Examples of this type of substituent are methyl, ethyl, n-propyl, iso-propyl, n-butyl, sec-butyl, iso-butyl, tert-butyl, pentyl, hexyl, heptyl, octyl, nonyl, decyl, dodecyl, tetradecyl, hexadecyl, cyclopentyl, cyclohexyl, methylcyclohexyl, benzyl, phenyl, tolyl, xylyl, dimethylphenyl, trimethylphenyl, ethylphenyl, butylphenyl, nonylphenyl and dodecylphenyl. Preferred substituents are hydrogen and methyl.

$A^-$ is an anion derived from an organic acid which is preferably a carboxylic acid, carboxylic acid anhydride, phenol, sulphurized phenol or sulphonic acid.

The carboxylic acid may be e.g.:

i) An acid of the formula $$RCOOH$$

where R is hydrogen, alkyl, cycloalkyl, alkenyl, cycloalkenyl, alkaryl, aralkyl, or aryl. Examples of such acids include formic acid, acetic acid, propionic acid, butyric acid, valeric acid, palmitic acid, stearic acid, cyclohexanecarboxylic acid, 2-methylcyclohexanecarboxylic acid, 4-methylcyclohexane carboxylic acid, oleic acid, linoleic acid, linolenic acid, cyclohex-2-eneoic acid, benzoic acid, 2-methylbenzoic acid, 3-methylbenzoic acid, 4-methylbenzoic acid, salicylic acid, 2-hydroxy-4-methylbenzoic acid, 2-hydroxy-4-ethylsalicylic acid, p-hydroxybenzoic acid, 3,5-di-tert-butyl-4-hydroxybenzoic acid, o-aminobenzoic acid, p-aminobenzoic acid, o-methoxybenzoic acid and p-methoxybenzoic acid.

ii) A dicarboxylic acid of the formula $$HOOC—(CH_2)_n—COOH$$

where n is zero or an integer, including e.g. oxalic acid, malonic acid, succinic acid, glutaric acid, adipic acid, pimelic acid and suberic acid. Also included are acids of the formula $$HOOC—(CH_2)_x—\overset{\overset{\displaystyle R}{|}}{CH}—(CH_2)_y—COOH$$

where x is zero or an integer, y is zero or an integer and x and y may be equal or different and R is defined as in (i). Examples of such acids include the alkyl or alkenyl succinic acids, 2-methylbutanedioic acid, 2-ethylpentanedioic acid, 2-n-dodecylbutanedioic acid, 2-n-dodecenylbutanedioic acid, 2-phenylbutanedioic acid, and 2-(p-methylphenyl)butanedioic acid. Also included are polysubstituted alkyl dicarboxylic acids wherein other R groups as described above may be substituted on the alkyl chain. These other groups may be substituted on the same carbon atom or different atoms. Such examples include 2,2-dimethylbutanedioic acid; 2,3-dimethylbutanedioic acid; 2,3,4-trimethylpentanedioic acid; 2,2,3-trimethylpentanedioic acid; and 2-ethyl-3-methylbutanedioic acid.

The dicarboxylic acids also include acids of the formula:

$$HOOC—(C_rH_{2r-2})COOH$$

where r is an integer of 2 or more. Examples include maleic acid, fumaric acid, pent-2-enedioic acid, hex-2-enedioic acid; hex-3-enedioic acid, 5-methylhex-2-enedioic acid; 2,3-di-methylpent-2-enedioic acid; 2-methylbut-2-enedioic acid; 2-dodecylbut-2-enedioic acid; and 2-polyisobutylbut-2-enedioic acid.

The dicarboxylic acids also include aromatic dicarboxylic acids e.g. phthalic acid, isophthalic acid, terephthalic acid and substituted phthalic acids of the formula:

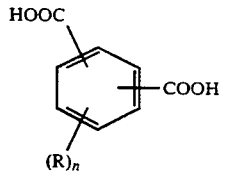

where R is defined as in (i) and n = 1, 2, 3 or 4 and when n > 1 then the R groups may be the same or different. Examples of such acids include 3-methylbenzene-1,2-dicarboxylic acid; 4-phenylbenzene-1,3-dicarboxylic acid; 2-(1-propenyl)benzene 1,4-dicarboxylic acid, and 3,4-dimethylbenzene-1,2-dicarboxylic acid.

The carboxylic acid anhydrides include the anhydrides that may be derived from the carboxylic acids described above. Also included are the anhydrides that may be derived from a mixture of any of the carboxylic acids described above. Specific examples include acetic anhydride, propionic anhydride, benzoic anhydride, maleic anhydride, succinic anhydride, dodecylsuccinic anhydride, dodecenylsuccinic anhydride, an optionally substituted polyisobutylenesuccinic anhydride, advantageously one having a molecular weight of between 500 and 2000 daltons, phthalic anhydride and 4-methylphthalic anhydride.

The phenols from which the anion of the quaternary ammonium compound may be derived are of many different types. Examples of suitable phenols include:

(i) Phenols of the formula:

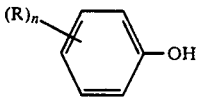

where n = 1, 2, 3, 4 or 5, where R is defined above and when n > 1 then the substituents may be the same or different. The hydrocarbon group(s) may be bonded to the benzene ring by a keto or thio-keto group. Alternatively the hydrocarbon group(s) may be bonded through an oxygen, sulphur or nitrogen atom. Examples of such phenols include o-cresol; m-cresol; p-cresol; 2,3-dimethylphenol; 2,4-dimethylphenol; 2,3,4-trimethylphenol; 3-ethyl-2,4-dimethylphenol; 2,3,4,5-tetramethylphenol; 4-ethyl-2,3,5,6-tetramethylphenol; 2-ethylphenol; 3-ethylphenol; 4-ethylphenyl; 2-n-propylphenol; 2-isopropylphenol; 4-isopropylphenol; 4-n-butylphenol; 4-isobutylphenol; 4-secbutylphenol; 4-t-butylphenol; 4-nonylphenol; 2-dodecylphenol; 4-dodecylphenol; 4-octadecylphenol; 2-cyclohexylphenol; 4-cyclohexylphenol; 2-allylphenol; 4-allylphenol; 2-hydroxydiphenyl; 4-hydroxydiphenol; 4-methyl-4'-hydroxydiphenyl; o-methoxyphenol; p-methoxyphenol; p-phenoxyphenol; 2-hydroxydiphenylsulphide; 4-hydroxydiphenylsulphide; 4-hydroxyphenylmethylsulphide; and 4-hydroxyphenyldimethylamine. Also included are alkyl phenols where the alkyl group is obtained by polymerization of a low molecular weight olefin e.q. polypropylphenol or polyisobutylphenol.

Also included are phenols of the formula:

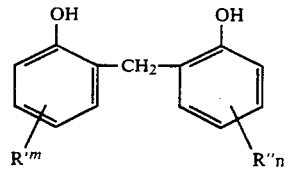

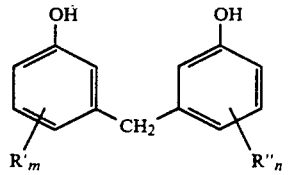

and/or

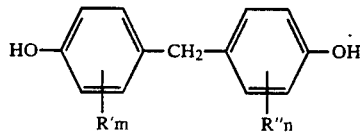

where R' and R'' which may be the same or different are as defined above for R and m and n are integers and for each m or n greater than 1, each R' or R'' may be the same or different. Examples of such phenols include 2,2'-dihydroxy-5,5'-dimethyldiphenylmethane; 5,5'-dihydroxy-2,2'-dimethyldiphenylmethane; 4,4'-dihydroxy-2,2'-dimethyl-dimethyldiphenylmethane; 2,2'-dihydroxy-5,5'-dinonyldiphenylmethane; 2,2'-dihydroxy-5,5'-didodecylphenylmethane and 2,2',4,4'-tetra-t-butyl-3,3'-dihydroxydiphenylmethane.

Also included are sulphurized phenols of the formula:

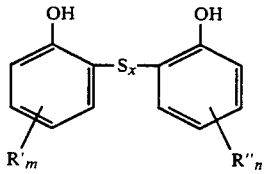

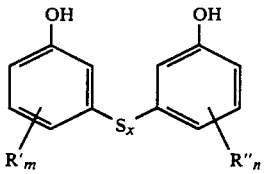

and/or

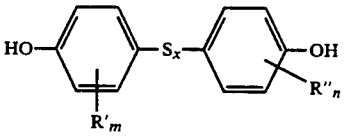

where R' and R'' which may be the same or different are as defined above, and m and n are integers, for each m and n greater than 1 each R' or R'' may be the same or different, and x is 1,2,3 or 4. Examples of such phenols include:

2,2'-dihydroxy-5,5'dimethyldiphenylsulphide;
5,5'-dihydroxy-2,2'-di-t-butyldiphenyldisulphide;
4,4'-dihydroxy-3,3'-di-t-butyldiphenylsulphide;

2,2'-dihydroxy-5,5'-dinonyldiphenyldisulphide;
2,2'-dihydroxy-5,5'didodecyldiphenyldisulphide;
2,2'-dihydroxy-5,5'-didodecyldiphenyltrisulphide; and
2,2'-dihydroxy-5,5'-didodecyldiphenyltetrasulphide.

The sulphonic acids from which the anion of the guanidinium salt can be derived include alkyl and aryl sulphonic acids which have a total of 1 to 200 carbon atoms per molecule although the preferred range is 10-80 atoms per molecule. Included in this description are aryl sulphonic acids of the formula:

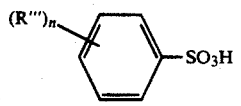

where n=1, 2, 3, 4, 5 and when n>1 the substituents may be the same or different, and R''' may represent R as defined above.

The hydrocarbon group(s) may be bonded to the benzene ring through a carbonyl group or the thio-keto group. Alternatively the hydrocarbon group(s) may be bonded to the benzene ring through a sulphur, oxygen or nitrogen atom. Thus examples of sulphonic acids that may be used include: benzene sulphonic acid; o-toluenesulphonic acid, m-toluenesulphonic acid; p-toluenesulphonic acid; 2,3-dimethylbenzenesulphonic acid; 2,4-dimethylbenzenesulphonic acid; 2,3,4-trimethylbenzenesulphonic acid; 4-ethyl-2,3-dimethylbenzenesulphonic acid; 4-ethylbenzenesulphonic acid; 4-n-propylbenzenesulphonic acid; 4-n-butylbenzenesulphonic acid; 4-isobutylbenzenesulphonic acid; 4-sec-butylbenzenesulphonic acid; 4-t-butylbenzenesulphonic acid; 4-nonylbenzenesulphonic acid; 2-dodecylbenzenesulphonic acid; 4-dodecylbenzenesulphonic acid; 4-cyclohexylbenzenesulphonic acid; 2-cyclohexylbenzenesulphonic acid; 2-allylbenzenesulphonic acid; 2-phenylbenzenesulphonic acid; 4(4'methylphenyl)benzenesulphonic acid; 4-methylmercaptobenzenesulphonic acid; 2-methoxybenzene sulphonic acid; 4-phenoxybenzenesulphonic acid; 4-methylaminobenzenesulphonic acid; 2-dimethylaminobenzenesulphonic acid; and 2-phenylaminobenzenesulphonic acid. Also included are sulphonic acids of the type listed above where R''' is derived from the polymerization of a low molecular weight olefin e.g. polypropylbenzenesulphonic acid and polyisobutylenebenzenesulphonic acid.

Also included are sulphonic acids of the formula:

$$R^6—SO_3H$$

where $R^6$ is alkyl, cycloalkyl, alkenyl or cycloalkenyl. Examples of such sulphonic acids that may be used include methylsulphonic acid; ethylsulphonic acid; n-propylsulphonic acid; n-butylsulphonic acid; isobutylsulphonic acid; sec-butylsulphonic acid; t-butylsulphonic; nonylsulphonic acid; dodecylsulphonic acid; polypropylsulphonic acid; polyisobutylsulphonic acid; cyclohexylsulphonic acid; and 4-methylcyclohexylsulphonic acid.

The guanidinium compounds can be synthesized in any suitable manner. Two methods are preferred for the synthesis of the guanidine compounds.

In the first method the guanidine or substituted guanidine is prepared by treating a guanidinium salt with an alkali metal hydroxide in an alcohol, e.g.,

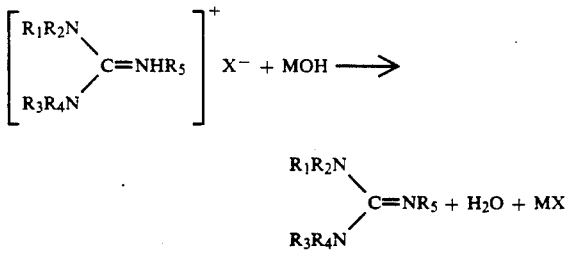

in which $R_1$, $R_2$, $R_3$, $R_4$ and $R_5$ are as defined above. In this type of reaction, X may be, e.g., fluoride, chloride, bromide, iodide, sulphate, sulphite, sulphide, methosulphate, ethosulphate, nitrite, nitrate, borate or phosphate. The metal M may be, e.g., lithium, sodium or potassium. The alcohol may be, e.g., methanol, ethanol, n-propanol or iso-propanol.

The metal salt is precipitated and filtered off and the solution of guanidine or substituted guanidine is mixed with the acid in a suitable solvent and allowed to react, e.g.,

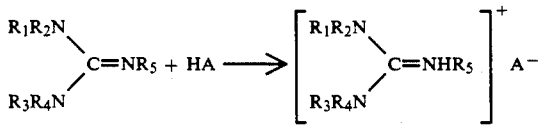

in which A is as defined above.

The rate of reaction may be increased by raising the reaction temperature above ambient temperature. Once the reaction is complete the solvents and water are removed by distillation.

In the second method, the organic acid is treated with a metal oxide or hydroxide to form the metal salt:

$$HA+MOH \rightarrow MA+H_2O$$

in which M and A are as defined above.

If this reaction is done in a suitable solvent (for example, heptane or toluene), the water formed during the reaction may be removed by refluxing the solvent and using a Dean & Stark trap. Once all the water has been removed, the solution of the metal salt is treated with a guanidinium salt or substituted guanidinium salt, e.g.,

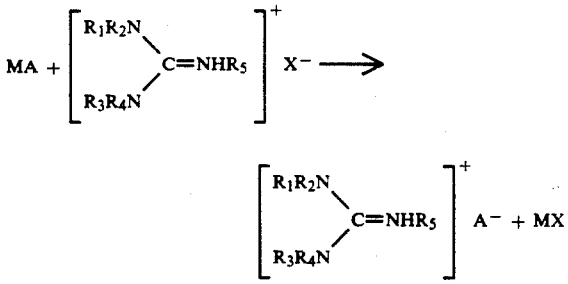

where $R_1$, $R_2$, $R_3$, $R_4$, $R_5$ and X are as defined above. The metal salt is removed by filtration and the solvent is removed by distillation. The order of these two final stages does not affect the quality of the final product.

The fuel composition advantageously comprises a minor proportion by weight of the guanidinium compound, preferably less than 1% by weight, more preferably from 0.000001 to 0.1%, especially 2 to 200 ppm.

The cracked component in the fuel oil which leads to the undesirable colour formation and sediment is generally obtained by cracking of heavy oil and may be fuel oil in which the main constituent is a fraction otained from a residual oil.

Typical methods available for the thermal cracking are visbreaking and delayed cokinq. Alternatively the fuels may be obtained by catalytic cracking, the principal methods being moving-bed cracking and fluidized-bed cracking. After cracking, the distillate oil is extracted by normal or vacuum distillation, the boiling point of the distillate oil obtained usually being 60°-500° C., and is a fraction called light-cycle oil, preferably corresponding to the boiling point range of light oil of 150°-400° C. Compositions composed entirely of this fuel or fuels which are mixtures of the cracked fraction and normal distillates may be used in the present invention.

The proportion by weight of direct-distillation fraction and cracked fraction in a fuel oil composition which is a mixture can vary considerably, but is usually 1:0.03-1:2 and preferably 1:0.05-1:1. Typically the content of cracked fraction is usually 5-97%, and preferably 10-50%, based on the weight of the composition.

The present invention accordingly also provides a fuel composition comprising a distillate fraction and a cracked fraction and a guanidinium compound soluble in the composition. The invention also provides the use of such a guanidinium compound in inhibiting sediment and color formation in a fuel oil composition, especially one containing a component obtained by the cracking of heavy oil.

The following examples illustrate the invention:

EXAMPLE 1

Preparation of Guanidinium Dodecylchenate

A solution of sodium hydroxide (10 g; 0.25 moles) in methanol (100 ml) was added to a solution of dodecylphenol (65.6 g; 0.25 moles) in toluene (100 ml). The mixture was heated to 64° C. to remove the methanol and then heated to 102° C. to reflux the toluene. After 3 hours of reflux, water (4.2 ml; 0.25 moles) had been collected in a Dean and Stark trap.

The reaction mixture was cooled to room temperature and a solution of guanidinium chloride (23.8 g; 0.25 moles) in methanol (200 ml) added. This mixture was heated to reflux for 2 hours and then the volatile solvents removed by raising the temperature to 150° C. under vacuum. The product was filtered through Dicalite 4200 (diatomaceous earth). The TBN was 19.6 mg KOH/g. This product and other guanidinium compounds synthesized in a similar manner were tested in a fuel which was a blend of a stable distillate (Fuel A) and an unhydrofined catalytically cracked gas oil (Fuel B). Fuel A contained 50 ppm of nitrogen and 0.24% sulphur. Fuel B contained 695 ppm of nitrogen and 1.11% sulphur.

Table 1 shows the effect on sediment and colour in the AMS 77.061 test of blending different amounts of the straight distillate fuel with the unhydrofined catalytically cracked gas oil.

Table 2 shows the nitrogen and sulphur contents of various fuels.

Table 3 shows the effect on colour and sediment of doping the stable fuel (A) with compounds containing nitrogen and sulphur.

TABLE 1

The Effect of Fuel Composition on Sediment and Colour in the AMS 77.061 Accelerated Stability Test

| Fuel A wt. % | Fuel B wt. % | Sediment mg/100 ml | Δ Colour (a) |
|---|---|---|---|
| 100 | 0 | 0.14 ± 0.09 | ≈0.5, <0.5, <0.5 |
| 80 | 20 | 0.61 ± 0.13 | ≈1.0, 1.0, 1.0 |
| 60 | 40 | 1.12 ± 0.10 | ≈1.0, ≈1.0, ≈1.0, ≈1.0 |
| 40 | 60 | 1.80 + 0.04 | ≈2.0, ≈2.0 |
| 20 | 80 | 2.10 ± 0.10 | ≈2.0, ≈2.0 |
| 0 | 100 | 2.90 | 6.0 |

(a) Colour change (ASTM D1500 test)

TABLE 2

The Nitrogen and Sulphur Contents of Various Fuels

| Type of Fuel | Nitrogen (ppm) | Sulphur (%) |
|---|---|---|
| Unhydrofined CCGO | 695 | 1.11 |
| " | 650 | 1.70 |
| Straight distillate | 50 | 0.24 |
| " | 70 | 0.25 |
| " | 97 | 0.23 |
| " | 128 | 0.24 |

TABLE 3

Effect of doping with dimethyl pyrrole (DMP) and a sulphonic acid (SA) on the stability of a straight distillate fuel in the AMS 77.061 test

| DMP ppm (a) | SA ppm (b) | Sediment (mg/100 ml) | Colour Before | Colour After | Δ C |
|---|---|---|---|---|---|
| Nil | Nil | 0.06, 0.10 | <0.5 | <1.0 | 0.5 |
| Nil | 50 | 0.02, 0.00 | <0.5 | <1.5 | 1.0 |
| | | | <0.5 | <1.5 | 1.0 |
| 50 | Nil | 0.76, 0.59 | <0.5 | <1.0 | 0.5 |
| | | | <0.5 | <1.0 | 0.5 |
| 50 | 50 | 1.06, 1.01 | <1.5 | <3.0 | 1.5 |
| | | | <1.5 | <3.0 | 1.5 |

(a) 2,5-dimethylpyrrole (b) A commercially available alkyl-aryl sulphonic acid having a standard acid number of approximately 80 mg KOH/g of acid.

EXAMPLES 2 TO 4

Table 4 shows the effect on sediment and colour in the AMS 77.061 test of adding 100 ppm of various guanidinium compounds prepared as described in Example 1 to a fuel consisting of 80 wt. % of Fuel A and 20 wt. % of Fuel B. Comparison of the results for the fuels treated with guanidinium compounds with the results for the untreated fuel shows the guanidinium compounds control sediment and colour.

Table 5 shows the long term storage characteristics of a fuel consisting of 80 wt. % of Fuel A and 20 wt. % of Fuel B to which 100 ppm of the guanidinium salt of Example 2 has been added. It can be seen that the sediment and colour of the treated fuel are much better after 112 days at 40° C. than that of the untreated fuel.

TABLE 4

| EXAMPLE NO. | GUANIDINIUM COMPOUND CATION | GUANIDINIUM COMPOUND ANION | TEST RESULTS SEDIMENT[a] | TEST RESULTS COLOUR[b] |
|---|---|---|---|---|
| | None | None | 1.18 ± 0.20[c] | ≈1.0 |
| 2 | $[(H_2N)_2C{=}NH_2]^{(+)}$ | DDP[d] | 0.53 ± 0.18[e] | ≈0.5, ≈0.5 |
| 3 | $[(H_2N)_2C{=}NH_2]^{(+)}$ | NPS[f] | 0.33 ± 0.09[e] | ≈0.5, ≈1.0 |

TABLE 4-continued

| EXAMPLE NO. | GUANIDINIUM COMPOUND CATION | ANION | TEST RESULTS SEDIMENT[a] | COLOUR[b] |
|---|---|---|---|---|
| 4 | $[(H_2N)_2C{=}NH_2]^{(+)}$ | PIBSATE[g] | 0.00 ± 0.00[c] | ≈0.5, ≈1.0 |

[a]mg/100 ml of fuel
[b]ASTM D1500 colour test
[c](mean ± standard deviation) of 14 tests
[d]dodecylphenate
[e](mean ± standard deviation) of 2 tests
[f]nonylphenol sulphide
[g]a polybutenyl succinic anhydride made from 950 molecular weight polyisobutene

TABLE 5

THE EFFECT OF A GUANIDINIUM COMPOUND IN LONG TERM STORAGE TESTS

| ADDITIVE | 0 DAYS SEDIMENT* | 0 DAYS COLOUR** | 28 DAYS SEDIMENT* | 28 DAYS COLOUR** | 56 DAYS SEDIMENT* | 56 DAYS COLOUR** | 84 DAYS SEDIMENT* | 84 DAYS COLOUR** | 112 DAYS SEDIMENT* | 112 DAYS COLOUR** |
|---|---|---|---|---|---|---|---|---|---|---|
| NONE | NIL | <2.0 | 0.72 | <2.5 | 2.34 | <3.0 | 2.26 | <3.0 | 3.02 | <3.5 |
| GUANIDINIUM DDP | NIL | <2.0 | 0.36 | <2.5 | 0.68 | <2.0 | 0.50 | <1.5 | 0.54 | <2.5 |

*Sediment: expressed as mg/100 g of fuel
**Colour: measured by the ASTM D1500 Test

What is claimed is:

1. A fuel oil composition comprising a diesel fuel oil or heating oil and an additive which is a guanidinium or substituted guanidinium of the general formula:

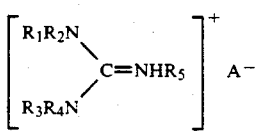

wherein $R_1$, $R_2$, $R_3$, $R_4$ and $R_5$ which may be the same or different are each hydrogen, or a substituted or unsubstituted alkyl, cycloalkyl, alkenyl or cycloalkenyl group, and $A^-$ is an anion derived from an organic acid, with the proviso that when the organic acid is a monocarboxylic acid of the formula RCOOH, R is selected from the group consisting of hydrogen, alkyl, cycloalkyl, alkaryl, aralkyl or aryl.

2. A composition according to claim 1 in which $R_1$, $R_2$, $R_3$, $R_4$ and $R_5$ are hydrogen.

3. A composition according to claim 1 in which $R_1$ is methyl and $R_2$, $R_3$, $R_4$ and $R_5$ are hydrogen.

4. A composition according to claim 1 in which $R_1$ and $R_2$ are methyl and $R_3$, $R_4$ and $R_5$ are hydrogen.

5. A composition according to claim 1 in which $R_1$, $R_2$, $R_3$ and $R_4$ are methyl and $R_5$ is hydrogen.

6. A composition according to claim 1, wherein the salt is derived from an acid selected from the group consisting of carboxylic acids, carboxylic acid anhydrides, phenols, sulphurized phenols, and sulphonic acids.

7. A composition according to claim 1 which comprises less than 1 wt. % of the guanidinium or substituted guanidinium salt.

8. A composition according to claim 1, in which the additive is the guanidinium salt of polyisobutylene succinic anhydride.

9. A composition according to claim 1 in which the fuel oil comprises 10 to 50% of cracked fraction and 90 to 50% of direct-distillation fraction.

10. A method of inhibiting colour and sediment formation in a fuel oil comprising adding to the fuel oil a guanidinium or substituted guanidinium salt of the general formula:

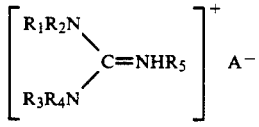

wherein $R_1$, $R_2$, $R_3$, $R_4$ and $R_5$ which may be the same or different are each hydrogen, or a substituted or unsubstituted alkyl, cycloalkyl, alkenyl or cycloalkenyl group, and $A^-$ is an anion derived from an organic acid, with the proviso that when the organic acid is a monocarboxylic acid of the formula RCOOH, R is selected from the group consisting of hydrogen, alkyl, cycloalkyl, alkaryl, aralkyl or aryl.

* * * * *